United States Patent [19]

Robson et al.

[11] Patent Number: 4,513,962

[45] Date of Patent: Apr. 30, 1985

[54] SPRING TYPE HAND GRIP EXERCISER

[76] Inventors: George E. Robson, 829 7th St., Hermosa Beach, Calif. 90254; Paul R. Anderson, 23701 Surf Cove, Laguna Niguel, Calif. 92677

[21] Appl. No.: 510,258

[22] Filed: Jul. 10, 1983

[51] Int. Cl.[3] ..... A63B 23/00

[52] U.S. Cl. ..... 272/68; 272/141; 272/142; 272/DIG. 5

[58] Field of Search ..... 272/68, 67, 93, 130, 272/142, 143, 135, DIG. 5

[56] References Cited

U.S. PATENT DOCUMENTS

| | | | |
|---|---|---|---|
| 3,045,793 | 7/1962 | Ylinen | 272/68 X |
| 3,216,259 | 11/1965 | Bendix | 272/68 X |
| 3,349,621 | 10/1967 | Mullen | 272/68 X |
| 3,807,729 | 4/1974 | Sigma | 272/68 |
| 4,262,898 | 4/1981 | Lee | 272/68 |

*Primary Examiner*—Richard J. Apley
*Assistant Examiner*—William R. Browne
*Attorney, Agent, or Firm*—Lawrence I. Field

[57] ABSTRACT

A spring type hand grip exerciser having a body with a pivoted lever that operates against a spring resistance force when the lever is moved toward the body of the exerciser. The hand grip exerciser contains a counter which counts the number of times a user grips and releases the lever and body. The hand grip exciser is free standing on a level surface.

3 Claims, 8 Drawing Figures

SPRING TYPE HAND GRIP EXERCISER

BACKGROUND OF THE INVENTION

The present invention relates to hand grip and related exercising equipment. Conventional hand grip exercisers are constructed by mounting a handle on each leg of a torsion spring, thereby creating an apparatus which resembles a wish bone, and requires a force which increases as the two legs of the torsion spring come together. This conventional hand grip exerciser has a shortcoming. In use, the hand grip exerciser requires a fixed force to initiate the bringing of the two legs of the torsion spring together which increases at a fixed rate as the two legs of the torsion spring are brought together.

Our embodiment introduces a means of adjusting both the initial force required to start bringing the two legs of the exerciser together, and the rate at which the force increases as the legs are brought together. Therefore, our embodiment is useable by persons with a greater range of strength. In addition, our embodiment incorporates a device which records each time the legs are brought together.

SUMMARY OF THE INVENTION

It is the object of the present invention to provide a hand grip exerciser in which the initial force required to start bringing the legs together and the rate the force increases as the legs are brought together, is adjustable. Therefore, it is useable to people of varying strength, and because the force can be adjusted by the user, it can be used as a training device.

A cycle counter enhances the hand grip exerciser as a training device because the used, in addition to increasing the force required to bring the two legs together, is informed of the number of cycles the device has been actuated. The hand grip exerciser is also free standing on a level surface.

BRIEF DESCRIPTION OF THE DRAWINGS

Referring to the accompanying drawings which are for illustrative purposes.

DETAILED DESCRIPTION OF PREFERRED EMBODIMENTS

Figure 1:
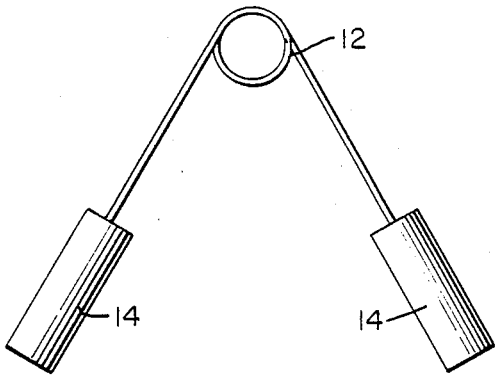
FIG. 1. (PRIOR ART)
FIG. 1 is a traditional torsion spring hand grip exerciser.

Referring to FIG. 1, the conventional hand grip exerciser consists of a torsion spring indicated by the number 12, and two handles indicated by the number 14. The user has to overcome the torque of the spring 12 to squeeze the handles 14 together.

Figure 2:
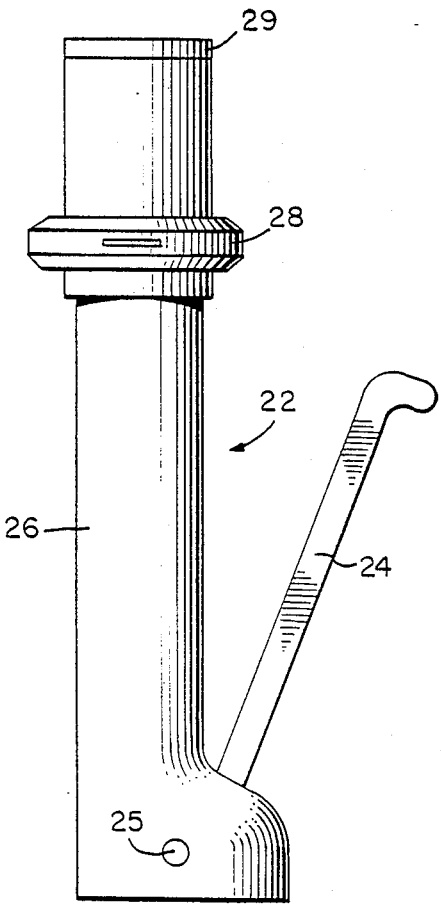
FIG. 2 is a side view of the preferred embodiment.

The preferred embodiment shown in FIG. 2, identified in general by the number 22, consists of a lever indicated by the number 24, pivot 25, body 26, and the selector knob 28. The force selector knob 28 in the preferred embodiment can change the force required to initiate the rotational movement of the lever 24 around the pivot 25 toward the body 26 and the rate at which that force increases as the lever 24 rotates toward the body 26. The method of changing the forces is described in the detailed description of FIG. 4 below.

The preferred embodiment also contains a cycle counter disk 29 which rotates as the lever 24 is cycled toward and away from the body 26, thereby counting each cycle. The cycle counter is described in the detailed description of FIG. 4 below.

Figure 3:
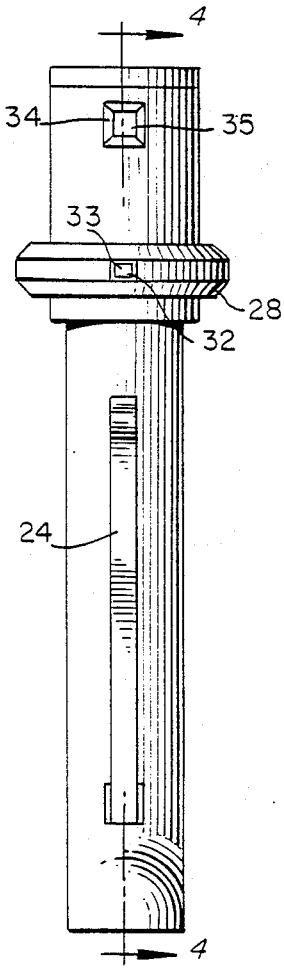
FIG. 3 is a back view of the preferred embodiment.

FIG. 3 is a view of the hand grip exerciser seen from the direction of a person operating the exerciser. The window 32 defines an orifice through which an indicator 33 showing the setting of the selector knob 28 can be seen. The window 34 defines an orifice through which a number 35 indicating the number of times the hand grip exerciser has been cycled.

Figure 4:
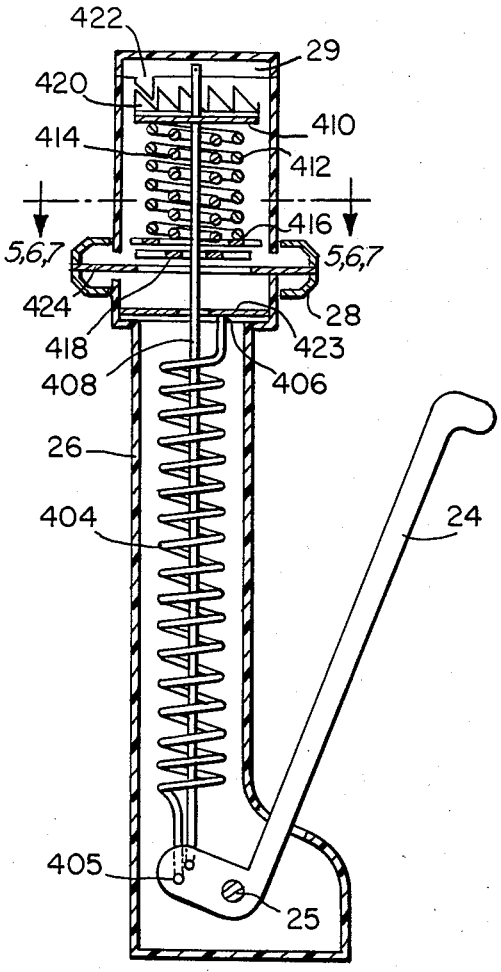
FIG. 4 is a cross section view of FIG. 3 along the line 4—4.

FIG. 4 is a cross section view taken along 4—4 in FIG. 3, showing the mechanism. The lever 24 is pivotably located in the body 26 by a pin 25. As the lever 24 is rotated toward the body 26 it extends the extension spring 404 attached on one end 405 to the lever 24 and on the other end 406 to the housing cross piece 423. The lever 24 also pulls the connecting rod 408 down as it is rotated toward the body 26. The connecting rod 408 is attached to the upper disk 410. The upper disk 410 is pulled down by the connecting rod 408 and therefore causes the compression spring 412 and the compression 414 to move downward also. The springs 412 and 414 are located on the lower surface by two spring retainers 416 and 418 which are selectively retained by the force selector 424 which is positioned by rotating the selector knob 28.

Figure 5:
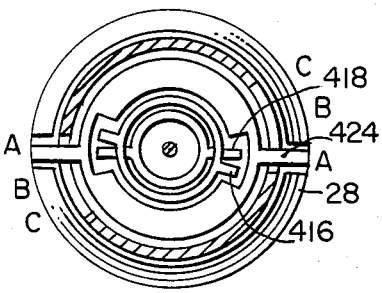
FIG. 5 is a cross section view of FIG. 4 taken along the line 5—5 showing the force selector 424 in a position not underneath either spring retainer 416 or 418, thereby not retaining either compression spring 412 or 414.
Figure 6:
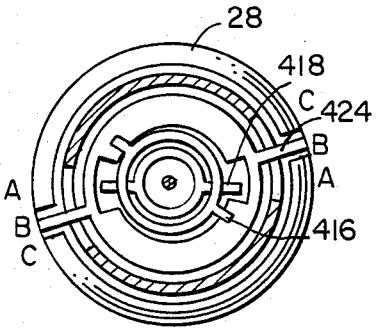
FIG. 6 is a cross section view of FIG. 4 taken along the line 5—5 showing the force selector 424 in a position underneath spring retainer 418, thereby retaining compression spring 414.
Figure 7:
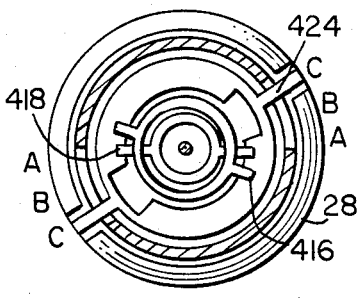
FIG. 7 is a cross section view of FIG. 4 taken along the line 5—5 showing the force selector 424 in a position underneath both spring retainer 416 and spring retainer 418, thereby retaining both compression springs 414 and 412.

The selector knob 28 can be located in one of three positions. In position A shown in FIG. 5, the force selector 424 is in a neutral position—not retaining either the outer spring retainer 416, or the inner spring retainer 418. Therefore neither of the compression springs 412 or 414 are retained, so the only force the operator need overcome is the extension spring 404. In position B as shown in FIG. 6, the force selector 424 is in the position to retain the outer spring retainer 416, thereby retaining spring 412 so the operator must overcome the extension spring 404 and the compression spring 412. In position C as shown in FIG. 7, the force selector 424 is in the position to retain both the outer spring retainer 416 and the inner spring retainer 418 thereby retaining both of the compression springs 412 and 414. The operator must overcome compression springs 412 and 414 in a addition to the extension spring 404. The operator has the option of selecting any of three loadings for the hand grip exerciser by rotating the force selector 424 to position A,B, or C with the selector knob 28.

The connecting rod is also attached to the cycle counter disk 29 located at the top of the hand grip exerciser. As the connecting rod 408 moves downwardly, the cycle counter disk 29 moves downwardly also. As the disk 29 moves down, the ratchet leg 420 comes in contact with an angular sloping face 422 on the inner surface of body 26 causing the cycle counter disk 29 to rotate clockwise one division causing the next higher number to show in the window 34 (FIG. 3).

Figure 8:
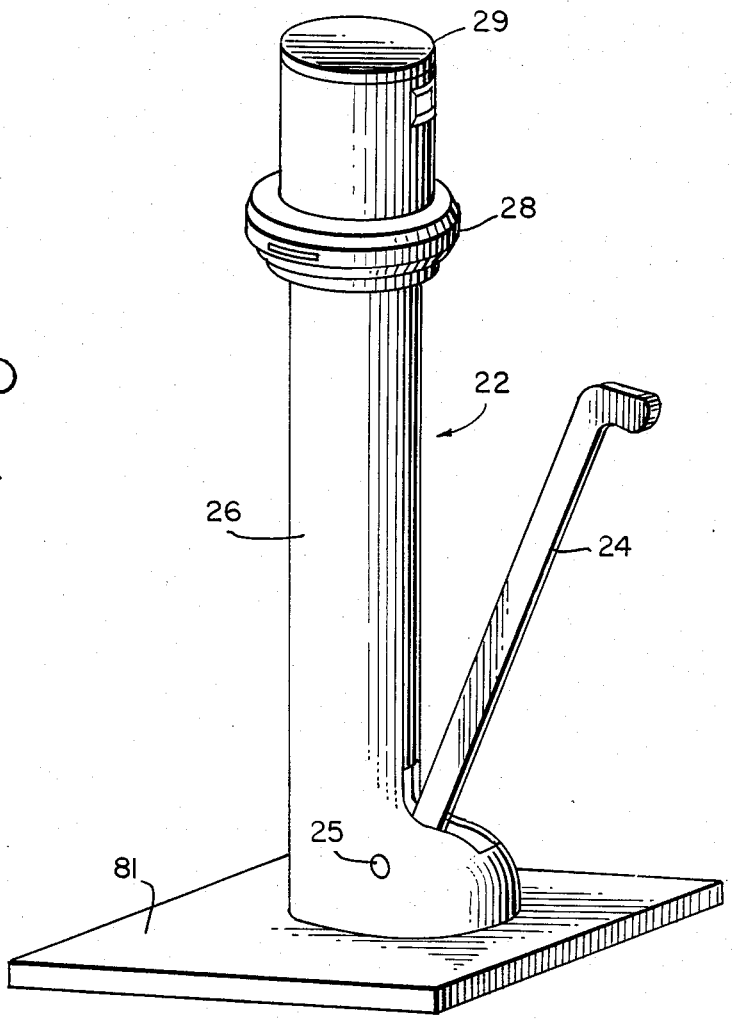
FIG. 8 is a perspective view of the preferred embodiment showing it free standing on a level surface.

FIG. 8 is a perspective view of the hand grip exerciser of the preferred embodiment. It is shown free standing on a horizontal surface 81. The advantage of this feature is twofold—firstly the hand grip exerciser may be conveniently stored in an upright position; and secondly, may be operated in this position.

The invention and its attendant advantages will be understood from the foregoing description and it will be apparent that various changes may be made in the form, construction, and arrangements of the parts of the hand grip exerciser without departing from the spirit and scope thereof, or sacrificing its material advantages, the arrangements herein before described being merely by way of example. We do not wish to be restricted to the specific forms shown, or uses mentioned, except as defined in the accompanying claims, wherein various poritons have been separated for clarity of reading and not for emphasis. For example, again referring to FIG. 4, the three springs 404, 412, and 414, may be increased in number, or they may be replaced by air chambers and valves to provide the rotation of the handle 24 toward the body 26 of the hand grip exerciser.

What is claimed is:

1. A spring type hand grip exerciser having a pair of members in which the initial force required to start bringing the two members together and the rate the force increases as the members are brought together is adjustable comprising:

a generally hollow body 26 having a first end and a second end, a base adjacent to said second end and being adapted to rest on a flat support surface such as a table;

a lever 24 extending into said body adjacent to said second end and attached to said body through a pivot pin 25 whereby said lever may be brought closer to said body by the exertion of force by a user, a first end of said lever extending outwardly from said hollow body and a second end of said lever engaging said pivot pin;

a first spring 404 one end of which is operatively connected to the second end 405 of said lever and the opposite end of which is fixedly connected to means 423 secured to said body at a location intermediate of the ends of said body;

a disc within said body, adjacent the first end of said body;

a rod 408, one end of said rod being secured to the second end of said lever and the other end of said rod being fixed to said disc;

two compression springs in said hollow body, separate retainer means supporting each of said springs between said disc and a force selector plate in said body;

a force selector knob means rotatably mounted on said hollow body for controlling each of said retainer means to selectively disengage one or both of said separate spring retainer means so that movement of said lever is opposed selectively by (1) only said first main spring 404, or (2) a combination of said first spring and one of said compression springs, or (3) a combination of said first spring and both of said compression springs.

2. The device of claim 1 wherein the body contains a window at its upper end, and a force indicator on said force selector knob readable through said window.

3. The device of claim 1 wherein the exerciser further includes a ratchet for counting each time the lever is brought closer to said body.

* * * * *